US011377887B2

(12) United States Patent
Cote et al.

(10) Patent No.: US 11,377,887 B2
(45) Date of Patent: Jul. 5, 2022

(54) SIDE LATCH EXIT DEVICE

(71) Applicant: Sargent Manufacturing Company, New Haven, CT (US)

(72) Inventors: Larry Cote, Coventry, CT (US); Timothy Schaeffer, North Haven, CT (US); Andrew S. Geraci, Wallingford, CT (US)

(73) Assignee: Sargent Manufacturing Company, New Haven, CT (US)

( * ) Notice: Subject to any disclaimer, the term of this patent is extended or adjusted under 35 U.S.C. 154(b) by 223 days.

(21) Appl. No.: 16/718,349

(22) Filed: Dec. 18, 2019

(65) Prior Publication Data

US 2020/0199922 A1 Jun. 25, 2020

Related U.S. Application Data

(60) Provisional application No. 62/783,487, filed on Dec. 21, 2018.

(51) Int. Cl.
*E05C 9/04* (2006.01)
*E05C 19/12* (2006.01)
(Continued)

(52) U.S. Cl.
CPC ..... *E05C 9/04* (2013.01); *E05B 63/20* (2013.01); *E05C 9/041* (2013.01); *E05C 9/22* (2013.01);
(Continued)

(58) Field of Classification Search
CPC ..... Y10T 292/0829; Y10T 292/08; Y10T 292/0801; Y10T 292/081; Y10T 292/0834;
(Continued)

(56) References Cited

U.S. PATENT DOCUMENTS 938,526 A * 11/1909 Voight ..... E05B 65/1006 292/21
1,247,052 A * 11/1917 Wilson ..... E05F 11/00 292/5
(Continued)

FOREIGN PATENT DOCUMENTS

CH 651886 A5 * 10/1985 ..... E05C 9/041
DE 202009005345 U1 * 6/2009 ..... E05C 9/22
(Continued)

OTHER PUBLICATIONS

[No Author Listed] Securitech Multi-Bolt. Version 9.3. 2012, 2 pages.
(Continued)

*Primary Examiner* — Kristina R Fulton
*Assistant Examiner* — Steven A Tullia
(74) *Attorney, Agent, or Firm* — Wolf, Greenfield & Sacks, P.C.

(57) ABSTRACT

An exit device for a door includes an actuator, a first rod, a second rod, a transom latch, and a side latch having a hook latch head. The side latch may be a mortise latch which may include a plurality of grooves for alignment during installation. When installed in an associated door, the exit device may withstand multiple impacts from windborne objects or pressures induced by high winds.

18 Claims, 14 Drawing Sheets

(51) Int. Cl.
*E05C 9/22* (2006.01)
*E05B 63/20* (2006.01)

(52) U.S. Cl.
CPC ..... *E05C 19/12* (2013.01); *E05Y 2900/132* (2013.01)

(58) Field of Classification Search
CPC ..... Y10T 292/0837; Y10T 292/0838; Y10T 292/0839; Y10T 292/084; Y10T 292/0845; Y10T 292/0851; Y10T 292/0852; Y10T 292/0853; Y10T 292/0854; Y10T 292/0857; Y10T 292/0859; Y10T 292/0908; Y10T 292/0909; Y10T 292/091; E05C 9/04; E05C 9/041; E05C 9/22; E05C 19/12; E05C 9/00; E05C 9/002; E05C 9/006; E05C 9/043; E05C 9/10; E05C 9/12; E05C 9/14; E05C 9/16; E05C 9/20; E05C 19/10; E05B 63/20; E05B 63/18; E05B 63/185; E05B 65/10; E05B 65/1006; E05B 65/1013; E05B 65/1046; E05B 65/1053; E05Y 2900/132; Y10S 292/21; Y10S 292/65
See application file for complete search history.

(56) References Cited

U.S. PATENT DOCUMENTS 1,324,181 A * 12/1919 Smith ..... E05B 63/20 292/336
1,408,629 A * 3/1922 Palmer ..... E05C 9/028 292/36
RE15,619 E 6/1923 Massoll
2,710,216 A * 6/1955 Eichacker ..... E05B 63/20 292/335
2,787,154 A * 4/1957 Wesberry ..... E05C 9/048 70/118
3,245,237 A * 4/1966 Eads ..... E05C 7/04 70/121
3,771,339 A * 11/1973 Smith ..... E05C 9/041 70/118
3,953,061 A * 4/1976 Hansen ..... E05C 9/002 292/5
4,005,886 A * 2/1977 Lirette ..... E05C 7/06 292/177
4,101,153 A * 7/1978 Dozier ..... E05B 1/0053 292/165
4,114,317 A * 9/1978 Crawley ..... E05D 15/066 49/209
4,427,223 A * 1/1984 Godec ..... E05B 63/0065 292/244
4,643,005 A * 2/1987 Logas ..... E05C 9/026 292/20
4,741,563 A * 5/1988 Cohrs ..... E05B 65/1046 292/168
5,509,703 A * 4/1996 Lau ..... E05C 3/042 292/1
5,622,397 A * 4/1997 Rice ..... E05B 13/002 292/259 R
5,722,704 A * 3/1998 Chaput ..... E05B 65/0811 292/26
6,000,733 A * 12/1999 Linder ..... E05B 65/1046 292/21
6,152,498 A 11/2000 Lindqvist
6,282,929 B1 * 9/2001 Eller ..... E05C 9/02 70/109
6,375,244 B1 * 4/2002 Smeltzer ..... E05C 9/041 292/32
6,560,925 B1 * 5/2003 Rice ..... E05B 13/002 292/259 R
7,712,799 B2 * 5/2010 Peng ..... E05B 65/1006 292/142
7,963,573 B2 * 6/2011 Blomqvist ..... E05C 9/046 74/104
8,267,440 B2 * 9/2012 Shen ..... E05B 65/1006 292/92
8,628,125 B2 * 1/2014 Huang ..... E05B 65/1006 292/142
9,441,410 B1 9/2016 Zorzi et al.
2003/0057714 A1 * 3/2003 Brown ..... E05B 65/1013 292/196
2003/0159477 A1 * 8/2003 Hoffmann ..... E05C 9/041 70/78
2004/0227352 A1 * 11/2004 Lin ..... E05B 65/102 292/92
2009/0134634 A1 * 5/2009 Atkinson ..... E05B 65/0858 292/26
2010/0066101 A1 * 3/2010 Shen ..... E05B 65/1006 292/92
2014/0130624 A1 * 5/2014 Chiang ..... E05C 9/046 74/104
2016/0002963 A1 * 1/2016 Kondi ..... E05B 65/1006 292/5
2016/0069107 A1 * 3/2016 Uyeda ..... E05B 65/1006 49/316
2016/0168879 A1 * 6/2016 Chen ..... E05B 65/1006 292/138
2016/0376816 A1 * 12/2016 Graham ..... E05B 65/1053 292/197
2017/0191288 A1 * 7/2017 Lin ..... E05B 65/1046
2017/0275922 A1 * 9/2017 Zeus ..... E05B 15/022
2017/0314299 A1 * 11/2017 Chen ..... E05B 79/04

FOREIGN PATENT DOCUMENTS

EP 0229582 A1 * 7/1987 ..... E05C 9/042
EP 0947651 A1 * 10/1999 ..... E05C 9/041
EP 1681413 A2 * 7/2006 ..... E05B 65/1006
EP 1717395 A1 * 11/2006 ..... E05C 9/041
EP 1 321 613 B1 7/2009
EP 3822438 A1 * 5/2021 ..... E05C 9/023
FR 1376505 A * 10/1964 ..... E05C 9/047
FR 2601063 A1 * 1/1988 ..... E05B 65/1006
FR 2924737 A1 * 6/2009 ..... E05C 9/041
GB 2 101 667 A 1/1983
GB 2 168 748 A 6/1986
GB 2279989 A * 1/1995 ..... E05C 9/041
GB 2330616 A * 4/1999 ..... E05C 9/185
GB 2503954 A * 1/2014 ..... E05C 9/041
WO WO-2010051592 A1 * 5/2010 ..... E05C 9/22

OTHER PUBLICATIONS

[No Author Listed] Appendix A.1—Test Protocols. Texas Tech University, National Wind Institute, Debris Impact Facility. Mar. 31, 2017:1-5.
Invitation to Pay Additional Fees for International Application No. PCT/US2019/066849, dated Feb. 24, 2020.
International Search Report and Written Opinion for International Application No. PCT/US2019/066849, dated Apr. 28, 2020.

* cited by examiner

SIDE LATCH EXIT DEVICE

RELATED APPLICATIONS

This application claims the benefit under 35 U.S.C. § 119(e) to U.S. Provisional Application Ser. No. 62/783,487, entitled "SIDE LATCH EXIT DEVICE", filed on Dec. 21, 2018, which is herein incorporated by reference in its entirety.

FIELD

Disclosed embodiments are related to a side latch exit device.

BACKGROUND

Vertical rod exit devices are traditionally used to secure a door at multiple latching points. Conventionally, doors are secured along the threshold and transom of the door and optionally along the jamb. Depending on the particular application, the vertical rods may be concealed inside of the door or attached to the outside of an interior surface of the door.

SUMMARY

In some embodiments, an exit device includes an actuator including a lever, a first cam, and a second cam, where the first cam is configured to convert an actuation force applied to the lever to a first force in a first direction, and where the second cam is configured to convert an actuation force applied to the lever to a second force in a second direction. The exit device also includes a first rod coupled to the first cam configured to transmit the first force in the first direction, a second rod coupled to the second cam configured to transmits the second force in the second direction, and a transom latch including a latch head configured to move between an engaged position and a disengaged position coupled to the first rod, where, when the first rod transmits the force in the first direction, the latch head is moved from the engaged position to the disengaged position. The exit device also includes a side latch including a hook latch head configured to move between a hook engaged position and a hook disengaged position coupled to the second rod, where, when the second rod transmits the force in the second direction, the hook latch head is moved from the hook engaged position to the hook disengaged position.

In some embodiments, an actuator for an exit device includes a chassis, a lever rotatably mounted to the chassis by a hinge portion and including a cam engagement portion, a first cam coupled to a first rod holder, where the first rod holder is slidably disposed in the chassis which allows movement of the first rod holder along a first axis, and a second cam coupled to a second rod holder, where the second rod holder is slidably disposed in the chassis which allows movement of the second rod holder along a second axis. The cam engagement portion engages the first cam and the second cam concurrently when the lever is rotated about the hinge by a user to move the first rod holder in a first direction along the first axis and the second rod holder in a second direction along the second axis.

In some embodiments, a rod actuated mortise latch includes a chassis configured to be secured to a door and a rod coupler including a channel configured to receive an associated rod of an exit device. At least two grooves are formed in the channel in a transverse direction relative to the channel, and the at least two grooves are configured to receive a retaining ring disposed on the associated rod.

In some embodiments, a method of installing a rod actuated mortise latch includes providing a door including a concealed rod and a mortise opening, wherein a portion of the concealed rod is disposed in the mortise opening, attaching a retaining ring to the portion of the concealed rod in the mortise opening, inserting a mortise latch having a chassis and a rod coupler into the mortise opening, and releasably securing the rod coupler to the concealed rod, whereby the rod coupler engages the retaining ring.

In some embodiments, a door includes a first door panel and an exit device attached to the first door panel. The exit device includes an actuator including a lever, a first cam, and a second cam, where the first cam is configured to convert an actuation force applied to the lever to a first force in a first direction, and where the second cam is configured to convert an actuation force applied to the lever to a second force in a second direction. The exit device also includes a first rod coupled to the first cam configured to transmit the first force in the first direction, a second rod coupled to the second cam configured to transmits the second force in the second direction, and a transom latch including a latch head configured to move between an engaged position and a disengaged position coupled to the first rod, where, when the first rod transmits the force in the first direction, the latch head is moved from the engaged position to the disengaged position. The exit device also includes a side latch including a hook latch head configured to move between a hook engaged position and a hook disengaged position coupled to the second rod, where, when the second rod transmits the force in the second direction, the hook latch head is moved from the hook engaged position to the hook disengaged position. When the first door panel is secured by the latch head in an engaged position and the hook latch head in the hook engaged position, the door withstands impact from a 6.8 kg 2×4 piece of lumber traveling at a speed between 80 mph and 100 mph.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
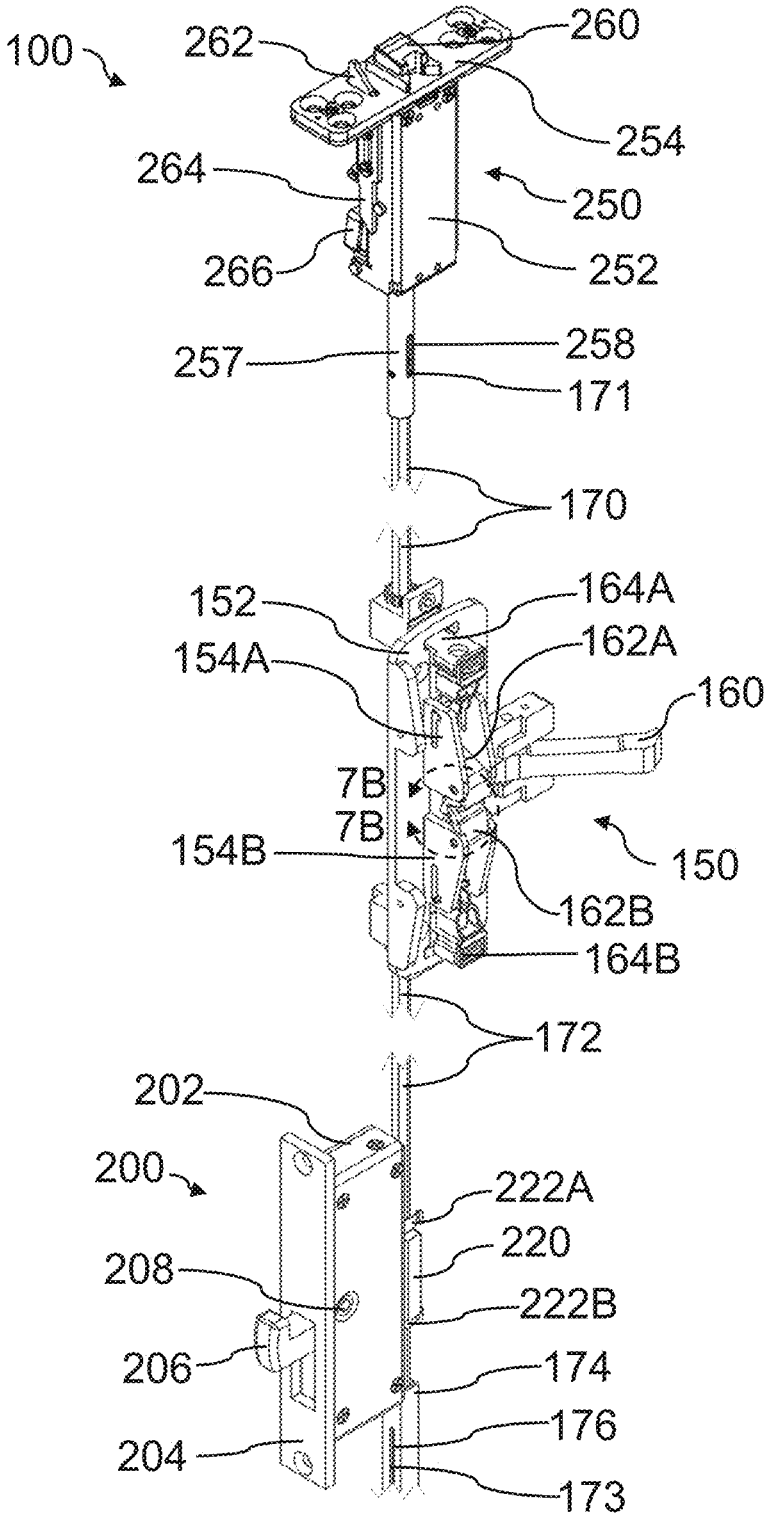
FIG. 1 is a perspective view of one embodiment of an exit device including a side latch.

Traditionally, multi-point latching exit devices are employed in doors to provide additional security or strength. These conventional exit devices employ vertical rods or tethers linked to a central actuator, by which a user can operate multiple latches with the same actuator. The vertical rods may be attached to the exterior of an interior door surface, or may be concealed inside of the door. Typically, these exit devices include a transom latch, a jamb latch, and a threshold latch providing three point fastening for the door which is suitable for environments with high wind and the associated risks of pressure and windborne objects impacting the secured door. Because conventional multi-point exit devices include a threshold latch, space must be made in the floor to accommodate the threshold latch. As many commercial floors are composed of a concrete slab, the installation of conventional threshold latches may be an expensive, time consuming, and laborious process. Additionally, because the threshold latch is formed in the floor, a threshold latch head and corresponding latch head receptacle may collect dirt or grime which may degrade the performance of the exit device over time or inhibit secure locking. In cases where the exit device is at least partially concealed inside of a door, maintenance or repairs of threshold latches with degraded performance may be expensive and time consuming. Additionally, installation or removal of threshold latches concealed in the door typically require removal of the door panel which is time consuming and labor intensive.

In view of the above, the inventors have recognized the benefits of a multi-point locking or latching device which includes a transom latch coupled to a first rod and a side latch coupled to a second rod which in combination secure a door. The side latch may include a hook latch head configured to positively grasp the door jamb when engaged. Such an arrangement may be beneficial to withstand high wind pressure loads and windborne objects in accordance with modern safety standards. The side latch may be easily installed or removed via a mortise opening in the door without removal of a door panel. The inventors have also recognized the benefits of an actuator including two cams which apply force to the first and second rods concurrently when a lever is rotated to promote reliable activation of the transom latch and side latch.

In some embodiments, an exit device includes an actuator, a transom latch, and a side latch. The actuator may be operatively coupled to the transom latch and the side latch so that the transom latch and side latch may be operated concurrently by a single actuation of the actuator. Accordingly, in some embodiments, the actuator may be connected to the transom latch by a first (i.e., upper) rod and the side latch connected to the side latch by a second (i.e., lower) rod. The first rod and second rod may be configured to move substantially linearly along a first axis and a second axis, respectively. Accordingly, when the actuator is actuated by a user, the first rod and second rod may be moved linearly along their respective axes to operate the transom latch and side latch. This may be accomplished in some embodiments by a cam arrangement in the actuator including a lever, a first cam, and a second cam. The first cam and second cam may be operatively coupled to the first rod and second rod, respectively, and may be configured to move the first rod and second rod when the lever is actuated (e.g., rotated). In particular, the lever may engage the first cam to move the first rod in a first direction to operate the transom latch and may engage the second cam to move the second rod in a second direction to operate the side latch. Thus, according to this embodiment, the transom latch and side latch may be operated concurrently by a single actuation of the lever.

In some embodiments, a side latch includes a chassis, a rod coupler, and a hook latch head. The hook latch head may be rotatably mounted to the chassis and may also include a plurality of gear teeth disposed in an arc. The rod coupler may be configured to receive a rod which is coupled to an exit device actuator and may be slidably mounted to the chassis by a guide rail, slot, or other suitable arrangement so that the rod coupled moves with the connected rod. The rod coupling may also include a plurality of gear teeth arranged in in a line which are configured to intermesh with the hook latch head gear teeth, so that the hook latch head forms a pinion and the rod coupler forms a rack. Accordingly, movement of the connected rod may be used to rotate the hook latch head between a hook engaged position and a hook disengaged position. Thus, actuation of a rod via an actuator may be used to move the hook latch head between the engaged and disengaged positions to selectively secure a door.

In some embodiments, a transom latch includes a latch head, a lockout, a trigger, and a biasing member. The latch head may be configured to move between an engaged position and a disengaged position. The latch head may also be configured to be operatively coupled to an associated rod which may move the latch head between the engaged and disengaged positions. The lockout may be configured to allow movement of the latch head toward the disengaged position but prevent movement toward the engaged position, thereby retaining the latch head in the disengaged position. The trigger may be configured as a second latch head including an inclined face and configured to move between an extended position and a retracted position. When the trigger is moved from the extended position to the retracted position, the trigger may release the lockout from the latch head to allow the latch head to move from the disengaged position toward the engaged position. For example, the trigger may be moved to the retracted position by an associated door transom strike when an associated door is closed to allow the latch head to move toward the engaged position to secure the door either manually or automatically. The biasing member of the transom latch may be used to urge or bias the latch head toward the engaged position. Accordingly, the biasing member may allow the latch head to automatically move toward the engaged position when released by the trigger. In some embodiments, the biasing member may also transmit biasing force to an associated rod to bias an associated exit device toward a secure position (i.e., where any latch heads are in the engaged position).

In some embodiments, a side latch may include a rod coupler including a plurality of grooves which promote simple installation of the side latch without removal of a door panel from a hinge interface. In cases where a concealed rod coupled to an actuator is disposed in a door, a portion of the concealed rod may be accessible through a mortise opening. The concealed rod may have a retaining ring (e.g., a spring clip) attached to the conceal rod in an annular groove formed in the rod. The retaining ring may have an outer diameter larger than that of the concealed rod so that the retaining ring may be used to transmit longitudinal force to the concealed rod (i.e., force in a direction of a longitudinal axis of the concealed rod). The rod coupler may include a channel configured to receive the concealed rod and a plurality of grooves formed in a transverse direction relative to the channel to receive the retaining ring. Accordingly, when the concealed rod is received in the rod coupler, longitudinal force may be transmitted between the rod coupler and the concealed rod by the retaining ring and the groove in which the retaining ring is received. In some embodiments, the rod coupler may include at least one spring clip configured to releasably attach the rod coupler to the concealed rod and inhibit removal of the concealed rod from the channel.

In some embodiments, a method for installing a side latch includes providing a door including a concealed rod and a mortise opening, where a portion of the concealed rod is disposed in the mortise opening. Accordingly, the concealed rod may be accessible through the mortise opening. The method may also include attaching a retaining ring to the concealed rod through the mortise opening. Attaching the retaining ring may include attaching the retaining ring to an annular groove formed in the concealed rod. The retaining ring may be a spring clip which is configured to be securely attached to the annular groove. In some embodiments, the concealed rod may be provided with the retaining ring pre-attached. The method may also include inserting a mortise latch including a chassis and a rod coupler into the mortise opening and releasably securing the rod coupler to the concealed rod. Releasably securing the rod coupler to the concealed rod may include receiving the concealed rod in a channel, receiving the concealed rod in at least one spring clip, and receiving the retaining ring in one or a plurality of grooves formed in a transverse direction across the channel. The channel and grooves may be open, so that when the mortise lock is inserted into the mortise opening the concealed rod is automatically secured to the rod coupler. In some embodiments, each of the plurality of grooves may include inclined lead-ins adjacent each of the grooves so that the retaining ring is reliably receiving in a slot when the mortise lock is inserted into the mortise opening. Thus, the mortise lock may be repeatable and reliably secured to the concealed rod in the door without removing the door panel.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 is a perspective view of one embodiment of an exit device 100 including an actuator 150, a side latch 200, and a transom latch 250. As shown in FIG. 1, a first rod 170 operatively couples the actuator to the transom latch 250 and a second rod 172 operatively couples the actuator to the side latch 200. According to the depicted embodiment, the exit device is configured to be mounted inside of the door (not shown in FIG. 1), so that a majority of the components are substantially concealed from view. Of course, the exit device may visible or partially concealed, as the present disclosure is not so limited. As shown in FIG. 1, the exit device is arranged with the first and second rods in a vertical orientation, with the transom latch configured to engage a door transom and the side latch configured to engage a door jamb. As the transom latch and side latch are both linked to the same centralized actuator, the transom latch and side latch may be actuated concurrently to selectively secure or release a door.

According to the embodiment shown in FIG. 1, the actuator 150 includes a chassis 152, a lever 160, a first cam 162A coupled to a first rod holder 164A, and a second cam 162B coupled to a second rod holder 164B. The lever is rotatably mounded to the chassis 152 and is configured to rotate about an axis which is parallel with a longitudinal axis of the first rod 170 and second rod 172. The first cam and second cam are also rotatably mounted to the chassis and are held by first guide wall 154A and second guide wall 154B, respectively, such that both of the cams rotate about an axis substantially orthogonal to the rotational axis of the lever. The first rod holder 164A is configured to secure the first rod 170 to the actuator, and is slidably mounted to the chassis so that the first rod may be moved along its longitudinal axis (i.e., a first axis). Likewise, the second rod holder 164B is configured to secure the second rod 172 to the actuator and is slidably mounted to the chassis to allow the second rod to be moved along its longitudinal axis (i.e., a second axis). The first rod holder is coupled to an end of the first cam so that rotational motion of the first cam causes linear motion of the first rod holder along the first axis. The second rod holder is coupled to an end of the second cam so that rotational motion of the second cam causes linear motion of the second rod holder along the second axis. As will be discussed further with reference to FIGS. 4-5, when the lever is rotated (i.e., actuated), the lever engages at least one of the first cam and the second cam to rotate the first and second cams in opposite directions. As the first and second cams are coupled to the first and second rod holders, respectively, the first rod holder is moved in a first direction along the first axis and the second rod holder is moved in a second direction along the second axis as the cams are rotated. According to the embodiment shown in FIG. 1, the first direction and second direction may be opposite one another such that the first rod holder and second rod holder are moved closer to one another when the lever is actuated (e.g., rotated).

As shown in FIG. 1, the side latch 200 includes a chassis 202, a face plate 204 and a hook latch head 206. The chassis is configured to fit into a mortise opening formed in a door, and may be secured to the door by the face plate. The hook latch head is rotatably mounted to the chassis via hook latch head pin 208. As shown in FIG. 1, the side latch is coupled to the second rod 172 by a rod coupler 220 which fits around the second rod. Spring clips 222A, 22B, releasably secure the second rod inside the rod coupler. As will be discussed further with reference to FIGS. 10-11, the rod coupler transmits longitudinal motion of the second rod into rotational motion of the hook latch head, so that movement of the second rod along the second axis may move the hook latch head between an engaged position and a retracted position. In the state shown in FIG. 1 the hook latch head is in an engaged position, projecting past the face plate 204 so that the hook latch head would engage an associated door jamb when adjacent a hook latch head receptacle. According to the embodiment of FIG. 1, the second rod 172 is disposed partially in a rod guide 174. The second rod guide includes a rod guide slot 176 which receives a second rod pin 173 disposed on the second rod. The second rod guide substantially constrains the second rod to linear movement along the second axis (i.e., the longitudinal axis of the second rod).

According to the embodiment of FIG. 1, the side latch may be disposed below a centerline of a door such that the door may be secured at different portions of the door (e.g., top and bottom portions). Without wishing to be bound by theory, the distance of the side latch head from the top of the door may at least partially determine the amount of deflection of a door place under pressure or impact loads. Accordingly, in some embodiments, the hook latch head of a side latch may positioned below a top of a door by a distance greater than ½ of the door length, ⅝ of the door length, ⅔ of the door length, ¾ of the door length, or any other appropriate distance. Correspondingly, the hook latch head may be positioned below a top of a door by a distance of less than ⅝ of the door length, ⅔ of the door length, ¾ of the door length, the door length, of any other appropriate distance. Combinations of the above noted ranges are contemplated, as the present disclosure is not so limited.

As shown in FIG. 1, the transom latch 250 includes a chassis 252, a face plate 254, a latch head 260, and a trigger 262. The latch head 260 may be directly coupled to the first rod 170 so that movement of the first rod along the first axis (i.e., a longitudinal axis of the first rod) moves the latch head between an engaged and disengaged position. According to the depicted embodiment, the latch head 260 does not include a substantially inclined face, and will therefore not automatically retract when the latch head contacts a transom strike plate. In order to prevent interference or premature engagement of the latch head with a transom strike plate, the transom latch includes a lockout 266 which is controlled by the trigger 262. According to the embodiment of FIG. 1, the lockout is configured to allow movement of the latch head toward a disengaged position (i.e., where the latch head is substantially retracted to clear a transom strike plate without interference). However, the lockout is configured to prevent movement of the latch head toward an engaged position (i.e., where the latch head is substantially extended to engage a transom strike plate). Accordingly, when the transom latch head is retracted the lockout will retain the transom latch head in the disengaged position so that the transom latch head does not interfere with door opening or closing. The trigger 262 is configured to move between an extended position and a retracted position and includes an inclined face which is suitable to automatically retract the trigger when the trigger contracts a transom strike plate. As shown in FIG. 1, the trigger is configured to engage the lockout when the trigger is moved to the retracted portion with a lockout engagement portion 264 configured as a camming surface. When the trigger engages the lockout (e.g., along a camming surface) the lockout may release the transom latch head 260 so that the latch head may move to the engaged position to secure the door once the door is closed. Thus, the latch head and trigger arrangement shown in FIG. 1 may allow for automatic latching of the transom latch head without inclusion of an inclined face on the transom latch head. According to the embodiment shown in FIG. 1, the chassis 252 is coupled to a transom rod guide 257 which includes a transom rod guide slot 258 with receives a first rod pin 171 disposed on the first rod to substantially constrain the movement of the first rod to linear movement along the first axis (i.e., the longitudinal axis of the first rod).

Figure 2:
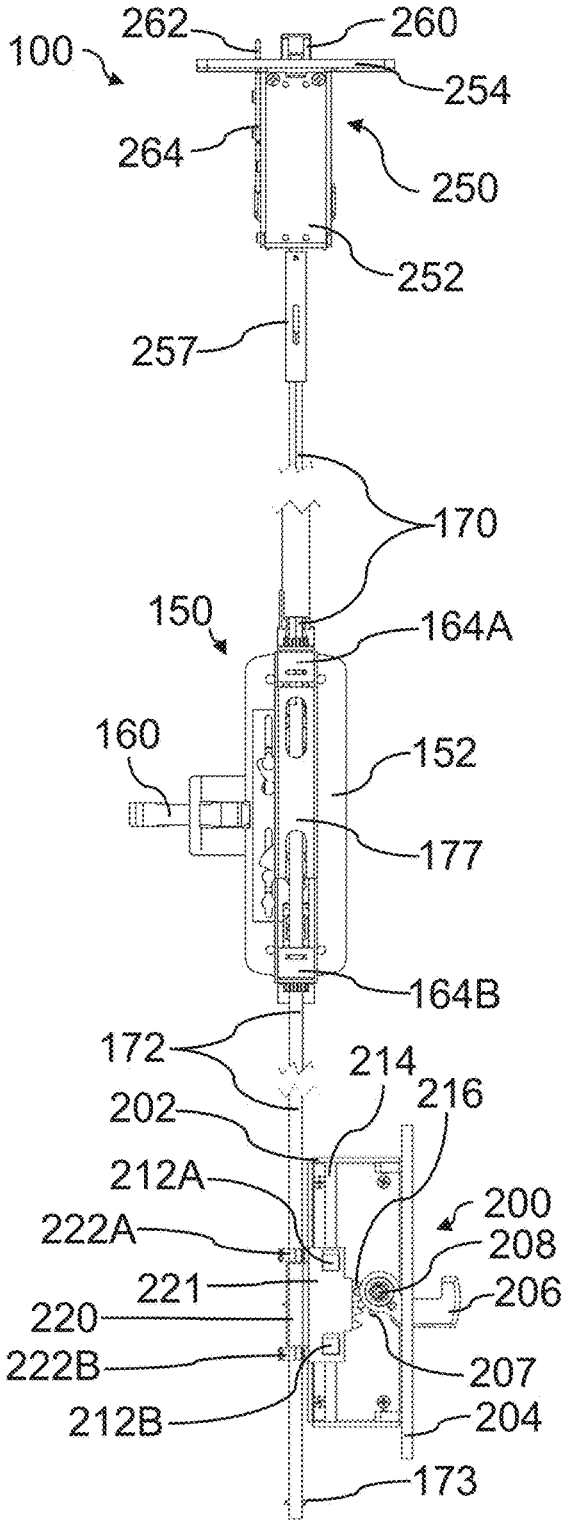
FIG. 2 is a rear elevation view of the exit device of FIG. 1.

FIG. 2 is a rear elevation view of the exit device 100 of FIG. 1. As shown in FIG. 2, the rear panel of the side latch 200 has been removed to show the internal components of the side latch. As discussed previously, the side latch includes a hook latch head 206 rotatably coupled to a chassis by a hook latch head pin 208 and a rod coupler 220 operatively coupled to the second rod 172 so that linear movement of the second rod is converted into rotational motion of the hook latch head. As shown in FIG. 2, the hook latch head includes a plurality of gear teeth 207 disposed in an arc in a circumferential arrangement around the hook latch head pin 208. Correspondingly, the rod coupler includes a slide body 221 which includes a plurality of gear teeth 216 configured to mesh with the teeth of the hook latch head. As shown in FIG. 2, the slide body 221 is disposed around guide rail 214 so that the slide body is constrained to move in a linear direction along the guide rail parallel to the longitudinal axis of the second rod. Accordingly, the rod coupler forms a rack and the hook latch head forms a pinion so that linear movement of the second rod is converted into rotational movement of the hook latch head which may be used to move the hook latch head between the hook engaged and hook disengaged positions.

As shown in FIG. 2, the actuator 150 also includes a rear actuator rod guide 177 which is configured to substantially constrain the first rod 170 and first rod holder 164A as well as the second rod 172 and second rod holder 164B to linear movement along the first axis of the first rod and second axis of the second rod, respectively. Accordingly, the actuator may use camming motions to precisely and reliably move the first and second rods along their longitudinal axis to actuate the transom latch and side latch.

Figure 3:
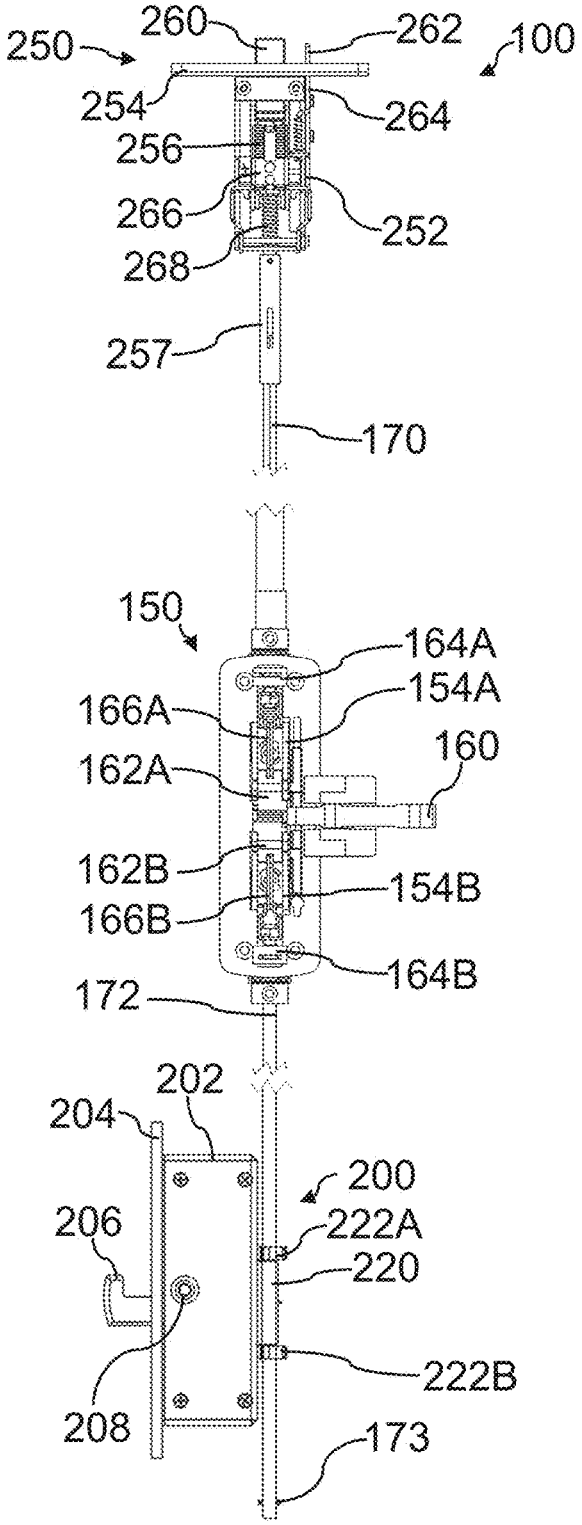
FIG. 3 is a front elevation view of the exit device of FIG. 1.

FIG. 3 is a front elevation view of the exit device 100 of FIG. 1. As discussed previously, the actuator 150 includes a lever 160, a first cam 162A, a second cam 162B which cooperate to move the first rod 170 and second rod 172 along the first axis and second axis, respectively. As shown in FIG. 3, the first cam is coupled to the first rod holder 164A by a first linkage 166A and the second cam is coupled to the second rod holder by a second linkage 166B. The first and second cam linkages are rotatably linked (e.g., by a linkage pin) to both their respective cams and rod holders so that the rotational motion of the cams may be converted into linear motion of the rod holders.

As discussed previously, the transom latch includes a trigger 262 and a lockout 266 which cooperate to allow the latch head 260 to automatically extend into a transom strike plate without interference when the door is being opened or closed. As shown in FIG. 3, the lockout 266 interfaces with a plurality of ratchet teeth 256 so that the latch head 260 is progressively retained at it is moved to the disengaged (i.e., retracted) position. When the trigger 262 is moved from the extended position shown in FIG. 3 to the retracted position, the lockout engagement portion 264 cams the lockout out of engagement with the ratchet teeth so that the latch head 260 may move to toward the engaged position. Of course, while ratchet teeth are employed in the depicted embodiment, any suitable progressive or non-progressive retaining element may be employed, as the present disclosure is not so limited. As shown in FIG. 3, the transom latch includes a biasing member configured as a compression spring which urges the latch head toward the engaged position. Accordingly, when released by the trigger, the latch head may automatically move to the engaged position under influence of the compression spring. Of course, while a compression spring is employed in the embodiment of FIG. 3, any suitable biasing member may be employed as the present disclosure is not so limited.

According to the embodiment shown in FIG. 3, the biasing member 268 may apply an urging force to the first rod 170 so that the first rod is urged to a position which corresponds to the transom latch head 260 being in an engaged position. As the urging force is transmitted through the first rod to the actuator and from the actuator to the side latch through the second rod, the hook latch head 206 may also be urged toward a hook engaged position. Thus, the linkage of the first rod and second rod through the actuator may allow a single biasing member to be employed in any one of the transom latch, actuator, and side latch. Such an arrangement may be beneficial to simplify installation and reduce parts and cost.

Figure 4:
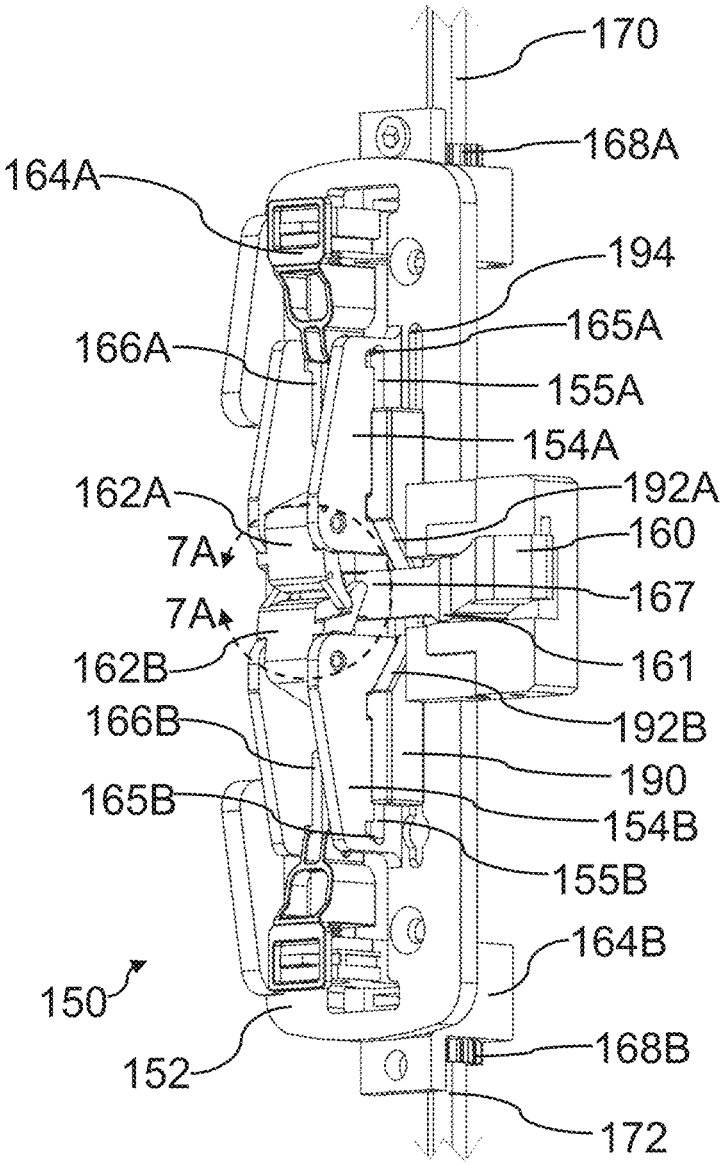
FIG. 4 is a perspective view of one embodiment of an actuator for the exit device of FIG. 1.

FIG. 4 is a perspective view of one embodiment of an actuator 150 for the exit device of FIG. 1. As discussed previously, the actuator is configured to allow a first rod 170 and a second rod 172 to move concurrently along a first axis (corresponding to a longitudinal axis of the first rod) and a second axis (corresponding to a longitudinal axis of the second rod), respectively. As best shown in FIG. 4, the lever 160 is rotatably mounted to the chassis by a hinge portion 161. A cam engagement portion 167 of the lever engages both the first cam 162A and the second cam 162B. The first cam and second cam are rotatably mounted to a first guide wall 154A and a second guide wall 154B, respectively. Accordingly, when the lever is rotated about the hinge portion, the cam engagement portion 167 will engage both the first cam and second cam to rotate the cams in opposite directions about parallel axes. The first cam is coupled to a first rod holder 164A by a first linkage 166A which converts the rotational motion of the cam to linear motion of the first rod holder. The first rod holder and first linkage are at least partially disposed in a first linkage slot 155A formed in the first guide wall 154A which at least partially constrains to the first linkage and first rod holder to linear movement. Similarly, the second cam is coupled to a second rod holder 164B by a second linkage 166B which is disposed at least partially in second linkage slot 155B formed in the second guide wall. According to the embodiment shown in FIG. 4, when the lever is rotated about the hinge portion 161, the cams draw the first rod holder and second rod holder closer together, thereby applying tension through the rods to a transom latch and/or side latch. Of course, in other embodiments, the cams may rotated to move the first rod holder and second rod holder further apart to apply compression through the rods, as the present disclosure is not so limited. As shown in FIG. 4, the relative position of the first and second rods to the first and second rod holder may be adjusted by rotating a first adjustment nut 168A or a second adjustment nut 168B, respectively.

As shown in FIG. 4, the actuator also includes a slider 190 disposed in a slider slot 194 formed in the chassis 152 of the actuator. The slider includes a first inclined camming surface 192A and a second inclined camming surface 192B which are configured to selectively engage the lever 160 to rotate the lever. As will be discussed further with reference to FIG. 6, the slider 190 may be operatively coupled to an interior handle or other actuator so that the lever may be actuated from a side of the door from which the lever is not accessible. When the slider engages the lever, the lever may be cammed to correspondingly rotate the first and second cams 162A, 162B to actuate an associated lock with the first rod 170 and second rod 172. According to the embodiment of FIG. 4, the lever may be operatively connected to a user interfacing element such as a paddle, push bar, or other suitable arrangement so that a user may easily actuate the lever.

Figure 5:
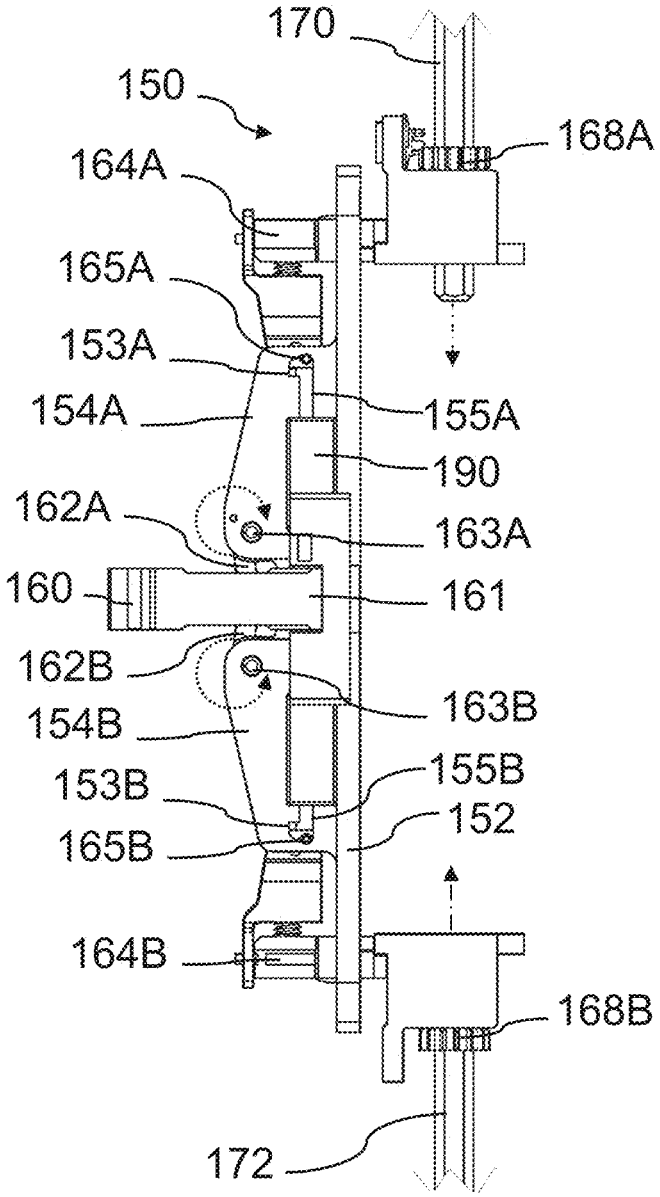
FIG. 5 is a right side elevation view of the actuator of FIG. 4.

FIG. 5 is a right side elevation view of the actuator 150 of FIG. 4. As best shown in FIG. 5, the first rod 170 and the second rod 172 are moveable along their longitudinal axes by movement of the first rod holder 164A and second rod holder 164B, respectively. The first rod holder is constrained at least partially to linear movement by first linkage pin 165A which is disposed in the first linkage slot 155A and couples the first rod holder to the first linkage (see FIG. 4). Likewise, the second rod holder is constrained at least partially to linear movement by second linkage pin 165B which is disposed in second linkage slot 155B and couples the second rod holder to the second linkage (see FIG. 4). According to the embodiment shown in FIG. 5, the first and second rods have coincident axes (i.e., the longitudinal axes of both rods are coincident). Accordingly, when the lever 160 is actuated the first and second rods are moved toward or apart from one another along the same coincident axis. As shown in FIG. 5, the first cam 162A is rotatably coupled to the first guide wall 154A by first cam pin 163A and the second cam 162B is rotatably coupled to the second guide wall 154B by a second cam pin 163B. In the depicted embodiment, the first cam and second cam are configured to rotate equally in opposite directions about their respective axes when engaged by the lever 160. As shown by the dashed arrows, in this embodiment, the first cam rotates clockwise relative to the page to move the first rod holder in a first direction (see dot-dash arrow) while the second cam rotates in a counterclockwise direction relative to the page to move the second rod holder in a second direction (see long-dot-dash arrow, where the first direction and the second direction are opposite one another and move the first and second rod holders closer together). Correspondingly, when the cams rotate in opposite directions the first and second rods will move further apart along their coincident axes. According to the embodiment of FIG. 5, rotation of the lever by a user may move the first and second rods closer together along their coincident axes, applying tension through the rods to move any associated lock to a disengaged position.

According to the embodiment shown in FIG. 5, the actuator includes first and second deadlatching catches 153A, 153B formed as a part of the first linkage slot 155A and second linkage slot 155B. The deadlatching catches are configured to prevent movement of the first rod holder 164A or second rod holder 164B without direct actuation of the lever 160. That is, force applied directly to the first or second rods may cause the first linkage pin 165A and second linkage pin 165B to engage and abut against first deadlatching catch 153A and second deadlatching catch 153B, respectively. Thus, force which is externally applied to the exit device (e.g., to a transom latch head or a hook latch head) may not move the rods to release the door. If the actuator is properly actuated, rotation of the first cam 162A and the second cam 162B may draw the first pin and second pin out of the deadlatching catches and into the first linkage slot 155A and second linkage slot 155B. The direction of rotation of the first cam and the second cam may be suitable to draw the pin out of the deadlatching catch to allow the first rod holder and second rod holder to move toward one another to release the door upon direct actuation of the lever 160.

Figure 6:
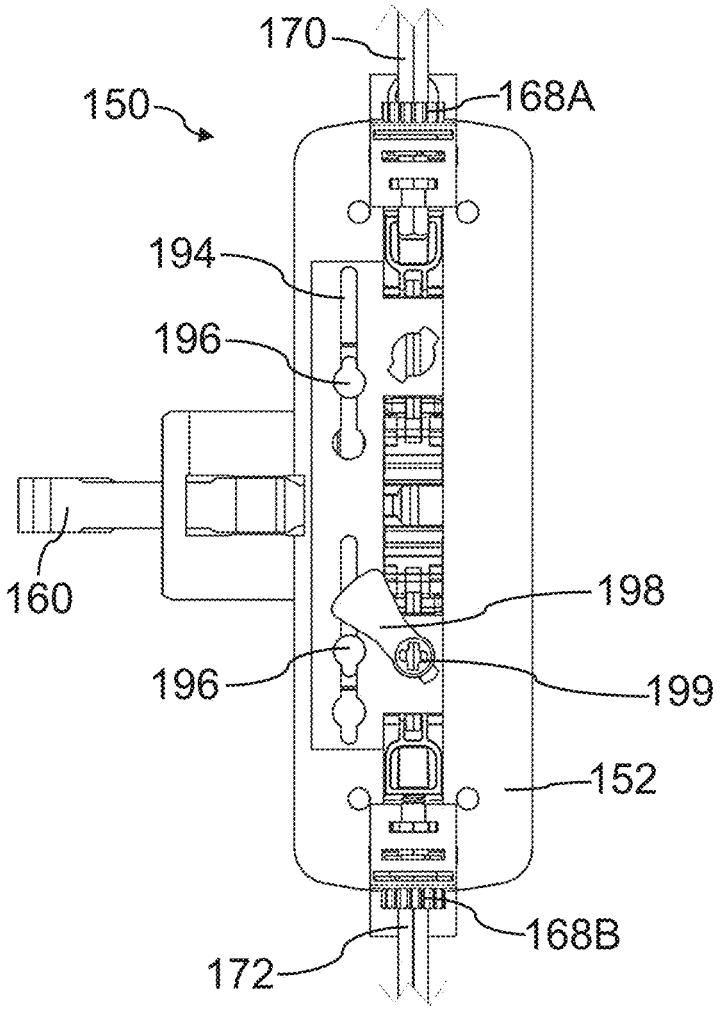
FIG. 6 is a rear elevation view of the actuator of FIG. 4.

FIG. 6 is a rear elevation view of the actuator 150 of FIG. 4. As best shown in FIG. 6, the actuator includes a handle mount 199 including a wing 198 configured to engage one of two tabs 196 of a slider (see FIG. 4). The tabs are disposed in slider slot 194. When an attached handle is turned, the wing 198 may engage one of the tabs 196 to slide the slider in the slider slot 194. As discussed previously, this movement may cause an inclined camming surface of the slider to engage the lever 160 to actuate the exit device (e.g., by moving the first rod holder and second rod holder toward one another). Of course, while a handle attachment and wing are shown in FIG. 6, any suitable arrangement may be employed to allow the exit device to be actuated from a side of the door where the lever is not accessible.

Figure 7A:
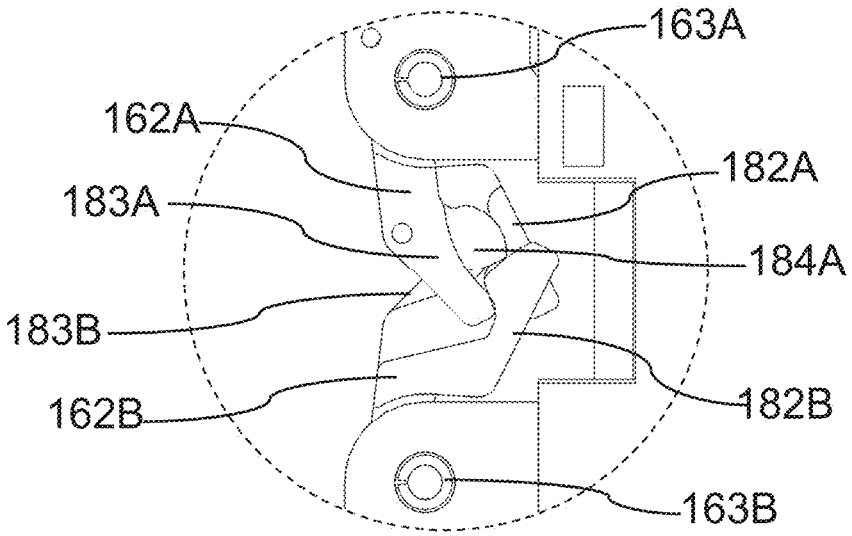
FIG. 7A is an enlarged right side view of section 7A of FIG. 4.
Figure 7B:
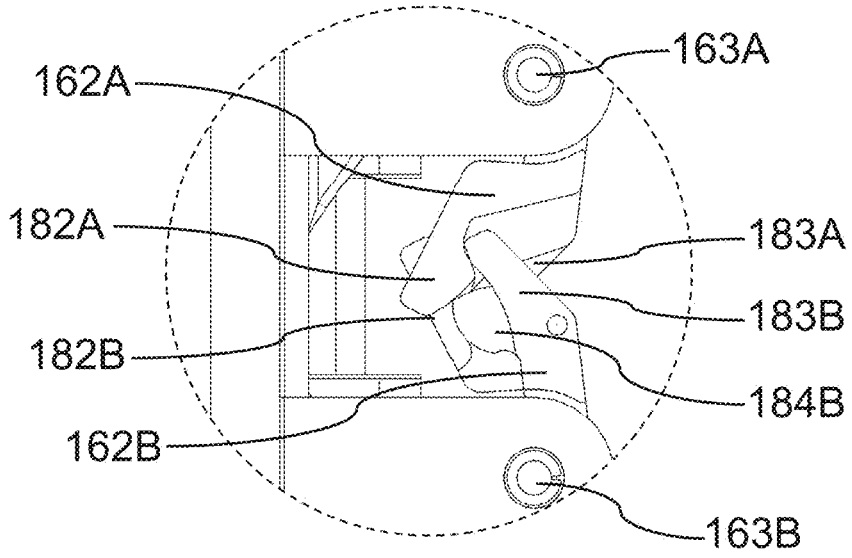
FIG. 7B is an enlarged left side view of section 7B of FIG. 1.

FIG. 7A is an enlarged right side view of section 7A of FIG. 4 and FIG. 7B is an enlarged left side view of section 7B of FIG. 1 depicting first cam 162A and second cam 162B with the lever removed for clarity. As shown in FIG. 7A, the first cam includes a first cam lobe 184A, a first upper arm 183A, and a first lower arm 182A. Similarly, as shown in FIG. 7B, the second cam includes a second cam lobe 184B, a second upper arm 183B, and a second lower arm 182B. As shown in FIG. 7A, the first upper arm engages the second lower arm. As shown in FIG. 7B, the second upper arm engages the first lower arm. Accordingly, the first and second cams are intermeshed and will rotate together about the first cam pin 163A and second cam pin 163B, respectively. That is, even in the case of misalignment of the lever so that the lever only engages one of the cam lobes, the cams will rotate concurrently so that the coupled rod holders will also move concurrently. Additionally, forces transmitted from one rod holder another rod holder may be transmitted through the intermeshed cams without interference or input of the lever. Thus, the intermeshed cam may provide reliable concurrent actuation of the exit device.

Figure 8:
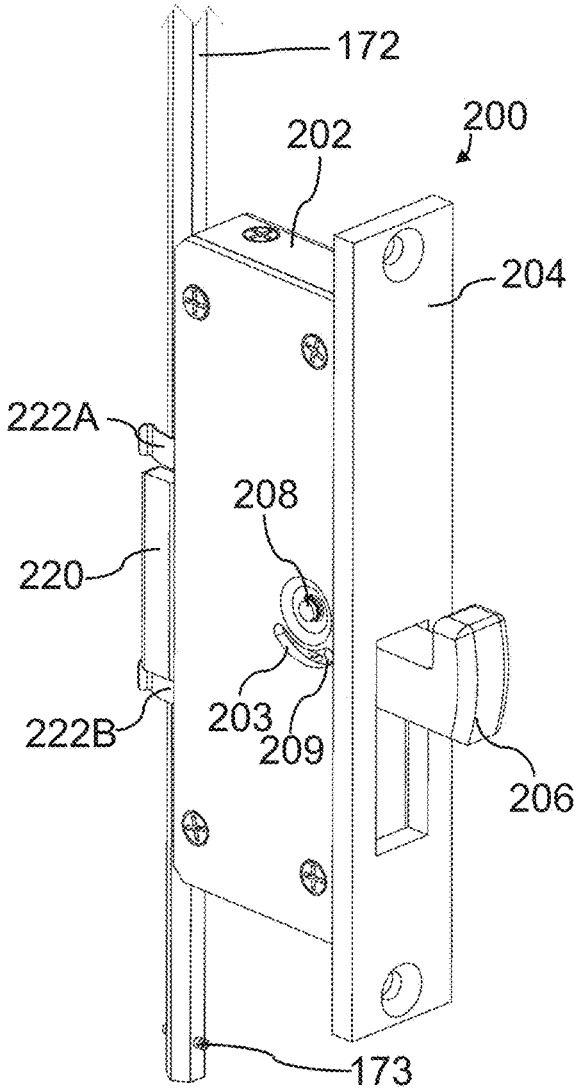
FIG. 8 is a perspective view of one embodiment of a side latch for the exit device of FIG. 1.

FIG. 8 is a perspective view of one embodiment of a side latch 200 for the exit device of FIG. 1. As discussed previously, the side latch includes a hook latch head 206 which is configured to rotate between a hook engaged position and a hook disengaged position. The hook latch head is rotatably mounted to the chassis 202 via a hook latch head pin 208. Additionally, as shown in FIG. 8, the chassis includes a hook latch head slot 203 which receives a hook latch head guide 209. In addition to guiding the hook latch head through rotational motion, the hook latch head slot 203 may also be used to set predetermined limits on the range of rotation of the hook latch head. That is, the hook latch head slot may determine the range of motion of the hook latch head so that the hook latch head may be reliably moved between the hook engaged and hook disengaged position to secure a door.

Figure 9:
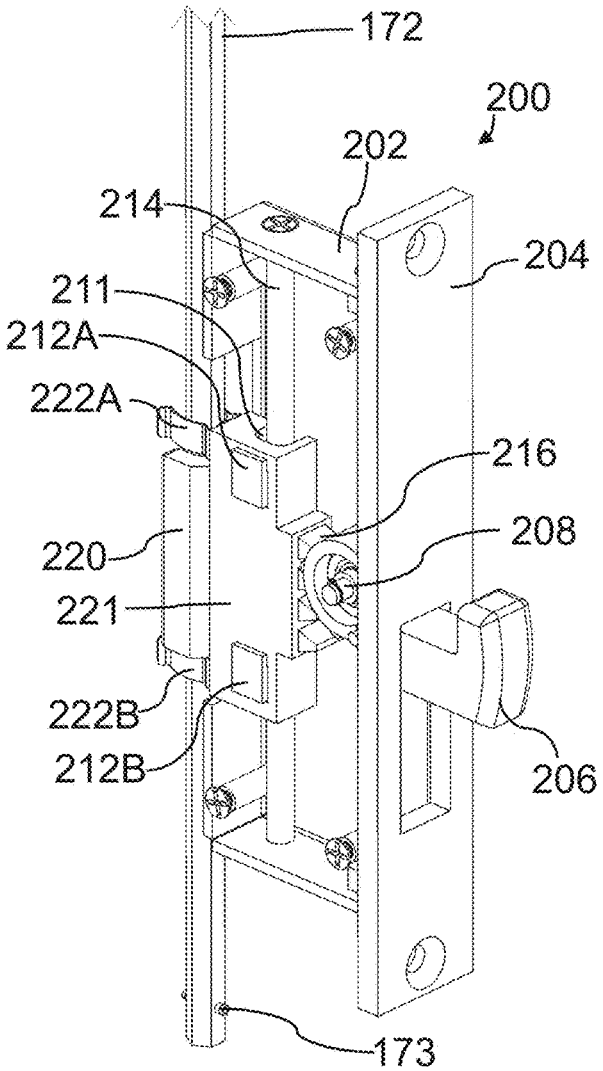
FIG. 9 is a perspective view of the side latch of FIG. 8 with a cover removed.

FIG. 9 is a cutaway perspective view of the side latch 200 of FIG. 8 with a portion of the chassis 202 removed to show the internal components of the side latch. As discussed previously, the side latch includes a rod coupler 220 and a hook latch head 206. The rod coupler includes a slide body 221 which receives linear motion of second rod 172 and converts it into rotary motion of the hook latch head via gear teeth 216. As best shown in FIG. 9, the slide body 221 is slidably coupled to the chassis 202 via a guide rail 214 disposed in a guide channel 211 formed in the slide body. The guide rail is secured in the guide channel 211 with a first clip 212A and a second clip 212B which secure the slide body to the guide rail but allow the slide body to move with second rod 172 to move the hook latch head between the hook engaged position and the hook disengaged position.

Figure 10:
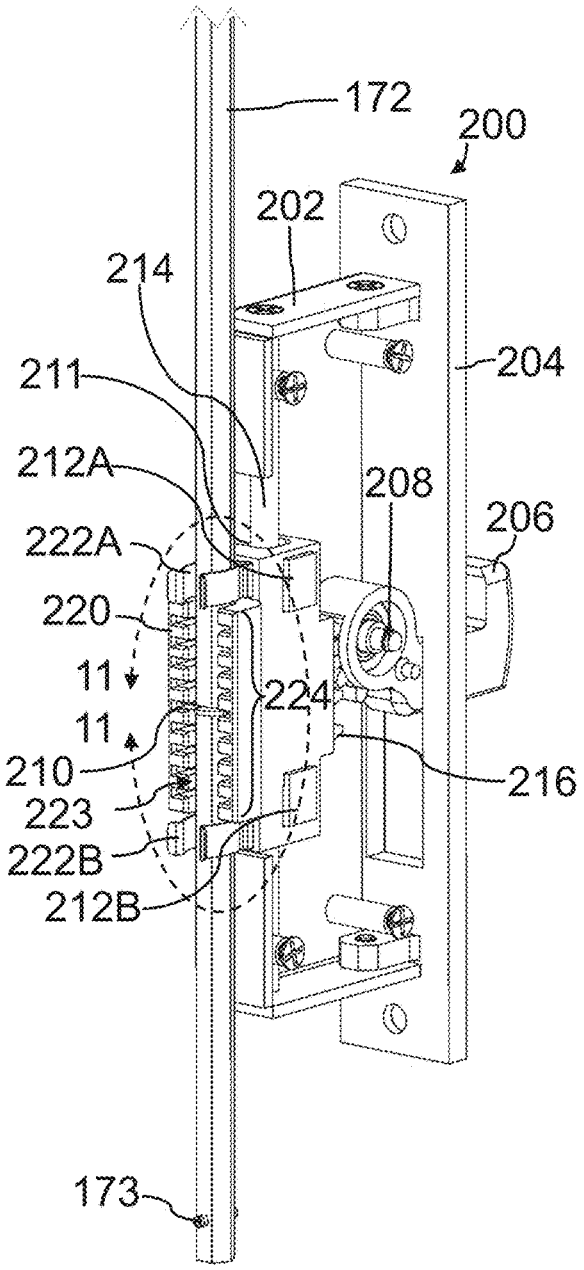
FIG. 10 is another perspective view of the side latch of FIG. 8 with a cover removed.

FIG. 10 is another cutaway perspective view of the side latch 200 of FIG. 8 showing the interface between the rod coupler 220 and the second rod 172. As shown in FIG. 10, the rod coupler includes a channel 223 which is formed to accommodate the second rod. The rod coupler also includes a first spring clip 222A and a second spring clip 222B which releasably secure the second rod 172 in the channel. The rod coupler also includes a plurality of grooves 224 which are formed in a transverse direction across the channel 223. The grooves are each configured to receive a retaining ring 210 which is attached to the second rod. The retaining ring may be releasably secured to an annular groove in the second rod so that the retaining ring may be used to transmit longitudinal force from the second rod. When the retaining ring is disposed in one of the grooves, force may be transmitted from the second rod to the rod coupler and vice versa via the interface between the groove and retaining ring. The spring clips 222A, 222B keep the retaining ring secure in the groove. Without wishing to be bound by theory, providing a plurality of grooves may allow for simplified installation of the side latch into a door. As will be discussed further with reference to FIG. 11, rather than adjusting the position of the retaining ring or second rod which may be concealed in a door, the side latch may be pushed into a mortise opening and the retaining ring will align with and engage the nearest groove of the plurality of grooves 224. Thus, minimal adjustment of the rod or the side latch may be necessary to install the side latch.

Figure 11:
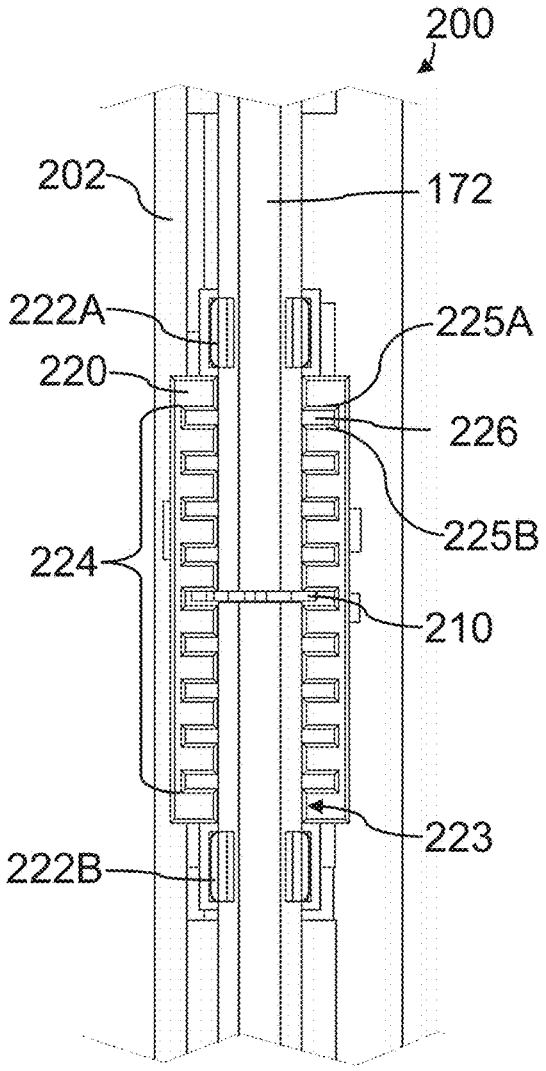
FIG. 11 is an enlarged elevation view of section 11 of FIG. 10.

FIG. 11 is an enlarged elevation view of section 11 of FIG. 10 showing the plurality of grooves 224 and retaining ring 210 in detail. As discussed previously, the second rod 172 is disposed in the rod coupler channel 223 and secured therein by spring clips 222A, 222B. Of course, while multiple spring clips are shown in FIGS. 10-11, any number of suitable retaining elements may be employed, as the present disclosure is not so limited. As best shown in FIG. 11, each of the plurality of grooves includes a first inclined lead-in 225A, and second inclined lead-in 225B, and a retaining groove 226. The inclined lead-ins may be suitable to guide the retaining ring into the nearest groove when the side latch is inserted into a mortise opening. That is, the lead-ins allow the second rod and retaining ring 210 to self-align with the nearest groove based on the camming action of the inclined lead-ins. Once disposed in the retaining groove 226, the retaining ring may transmit force between the rod coupler 220 and the second rod so that the hook latch head (see FIGS. 8-9) may be moved between a hook engaged and a hook disengaged position. According to the embodiment shown in FIGS. 10-11, the rod coupler includes nine grooves which provide a suitable amount of self-adjustability between the side latch and the second rod. However, any suitable number of grooves may be employed to provide any suitable amount of adjustability, including, but not limited to, as few as two grooves and as many as 20 grooves.

Figure 12:
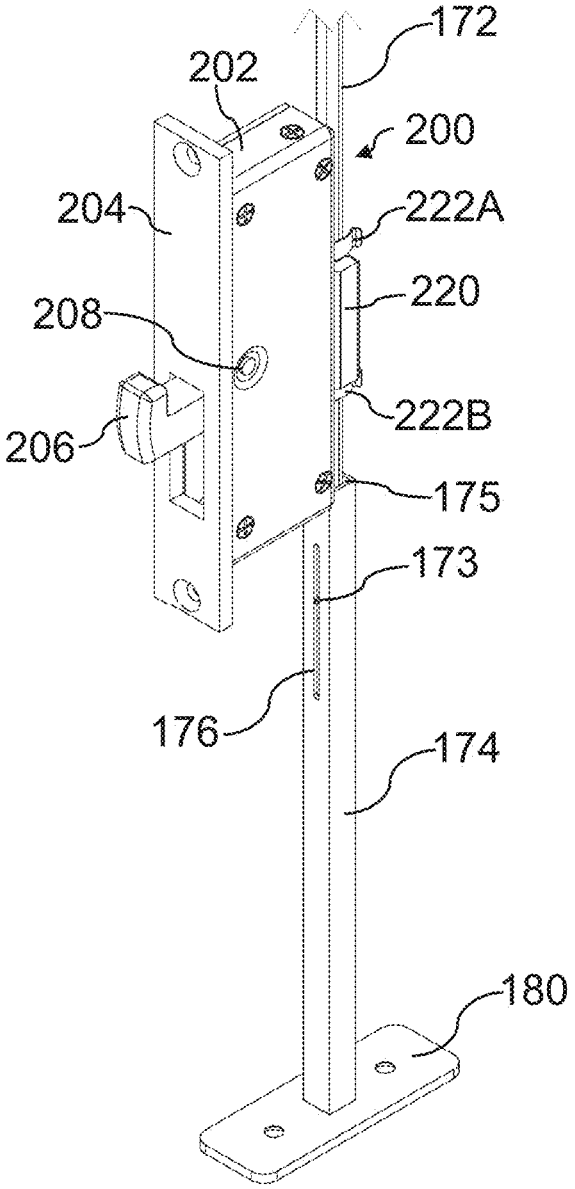
FIG. 12 is a perspective view of the side latch of FIG. 9 and one embodiment of a rod guide.

FIG. 12 is a perspective view of the side latch 200 of FIG. 9 and one embodiment of a rod guide 174. As shown in FIG. 12, the rod guide includes a rod channel 175, and rod guide slot 176, and a base 180. The base is configured to be mounted to the threshold portion of a door to secure the rod guide to the door. The rod channel 175 receives the second rod 172 and may be shaped and sized to limit the range of motions for the second rod. That is, the second rod may be closely fit or have a complementary shape with the rod channel so that the second rod is substantially constrained to linear motion along its longitudinal axis and alignment between the second rod and side latch is maintained. Additionally, the rod guide slot 176 is configured to receive a second rod pin 173 so that the motion of the second rod is further limited to motion along its longitudinal axis. Such an arrangement may promote reliable and consistent actuation of the side latch. Additionally, as shown in FIG. 12, the rod guide may extend from the bottom the door past to a position proximate the chassis 202 of the side latch. That is, the rod guide may be approximately equidistant from the bottom of a door relative to the bottom of the chassis of the side latch. Such an arrangement may provide substantial stability to the second rod without interference with the installation or operation of the side latch. Of course, the rod guide may have any suitable shape or extend any suitable distance from the bottom of the door to effectively guide the second rod, as the present disclosure is not so limited.

Figure 13:
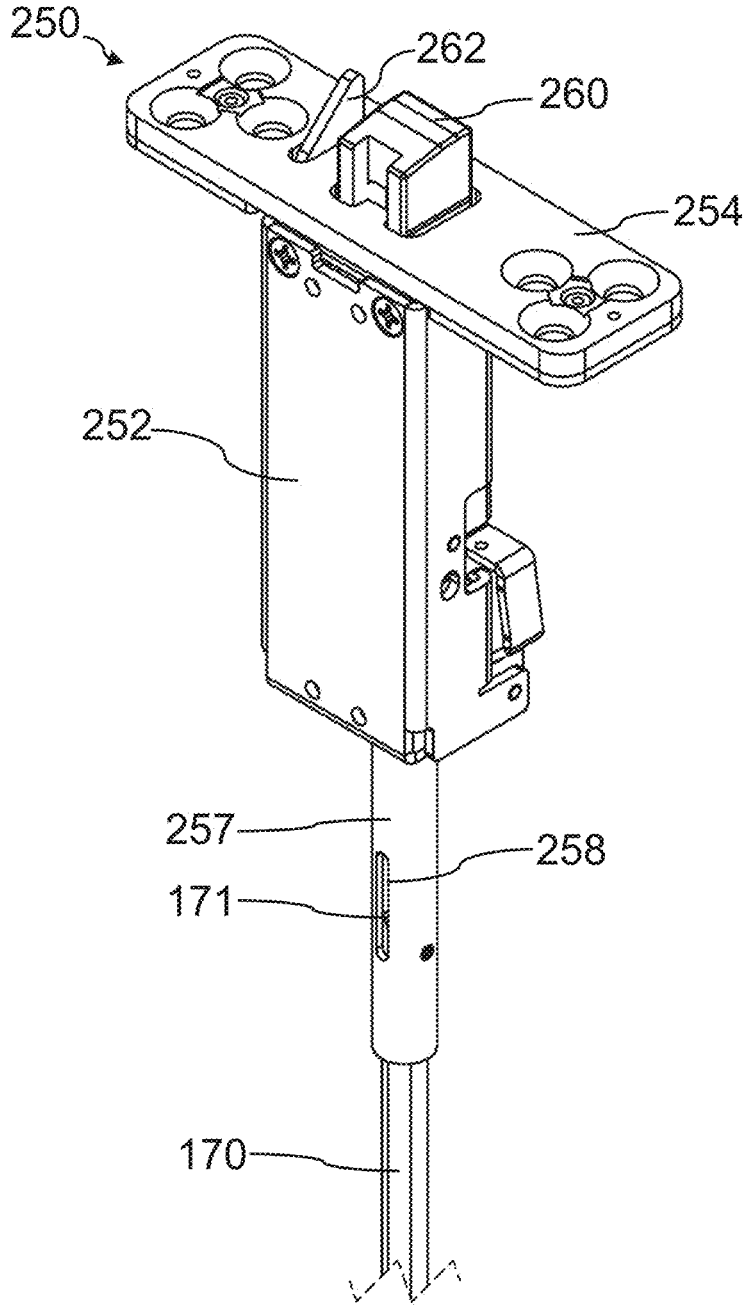
FIG. 13 is a perspective view of one embodiment of a transom latch for the exit device of FIG. 1.

FIG. 13 is a perspective view of one embodiment of a transom latch 250 for use in the exit device of FIG. 1. As discussed previously, the transom latch is configured to secure an associated door to a doorway transom. The transom latch includes a chassis 252 which is secured in the top of the door by transom face plate 254. The transom latch includes a latch head 260 and a trigger 262. The trigger 262 has an inclined face and is configured to automatically retract when the trigger strikes a transom strike plate, whereas the latch head 260 is not configured to automatically retract. Accordingly, the trigger may be employed to time the release of the latch head 260 so that the latch head does not interfere with a transom strike plate when opening or closing the door, as will be discussed further with reference to FIG. 14. As shown in FIG. 13, the chassis 252 of the transom latch includes a transom rod guide 257 which is configured to receive the first rod 170. The first rod guide includes a transom rod guide slot 258 configured to receive a first rod pin 171 which constrains the motion of the first rod to linear motion along its longitudinal axis and maintains alignment of the first rod with the transom latch. Accordingly, the first rod 170 may be used to reliably move the latch head 260 between engaged and disengaged positions with linear motion.

Figure 14:
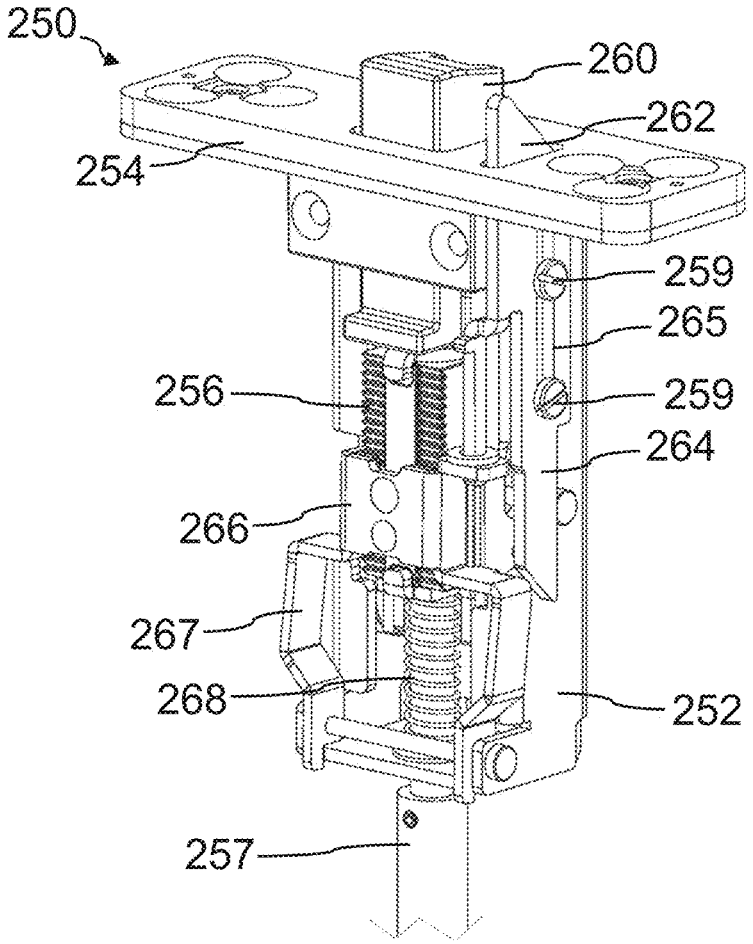
FIG. 14 is another perspective view of the transom latch of FIG. 13.

FIG. 14 is another perspective view of the transom latch 250 of FIG. 14 showing the lockout 266 and trigger 262 in detail. As best shown in FIG. 14, the trigger 262 is configured to slide on trigger supports 259 disposed in trigger slot 265. The trigger includes a lockout engagement portion 264 which is configured as a camming surface which moves the lockout when the trigger is moved from the extended position shown in FIG. 14 to a retracted position. The lockout 266 is disposed on a rotatable lockout arm 267 and is configured to engage a plurality of ratchet teeth 256. The lockout may be spring loaded so that the lockout positively engages the ratchet teeth in a resting position. The ratchet teeth are configured to allow the latch head 260 to move from the engaged position (e.g., extended position) shown in FIG. 14 to a disengaged position (e.g., a retracted position) but does not allow the opposite motion. Accordingly, when the latch head is retracted by activation of an associated actuator and tension applied through a first rod, the lockout progressively engages the ratchet teeth to maintain the latch head in the disengaged position. When the associated actuator is released (e.g., when the door is fully open), the latch head is kept in the disengaged position by the lockout against the urging of a biasing member 268 which urges the latch head toward the engaged position. When the door closes and the trigger is retraced by a transom strike plate, the lockout engagement portion (i.e., a first camming surface) engages the rotatable lockout arm (i.e., a second camming surface) to move the lockout up and away from the ratchet teeth. When the lockout clears the ratchet teeth, the latch head may automatically return to the engaged position under influence from the biasing member 268. The trigger 262 may be configured so that the lockout does not clear the ratchet teeth to release the latch head until the latch head is positioned over a transom latch head receptacle so that interference during extension is minimized or eliminated.

According to the embodiment shown in FIG. 14 and as discussed previously, the biasing member 268 may be used to bias the entirety of the exit device mechanism toward a secure position (i.e., where all associated latches are in engaged positions). Accordingly, the lockout 266 may also be used to control the motion of the entirely of the exit device, and, in particular, an associated side latch having a hook latch head (see FIGS. 8-9). That is, when the exit device is actuated and the latch head is moved to a disengaged position, a hook latch head of the side latch may also be moved to a hook disengaged position. When the lockout engages the ratchet teeth 256, it may hold both the latch head 260 and the hook latch head in the disengaged positions so that there is no interference opening and closing the door. When the trigger causes the lockout to clear the ratchet teeth, the latch head and the hook latch head may be released so that they may be moved to the engaged and hook engaged positions, respectively. The trigger may be configured to release the latch head and hook latch head once each of the latch heads is positioned over a corresponding receptacle so that interference between the latch heads and the doorway is reduced or eliminated.

Figure 15:
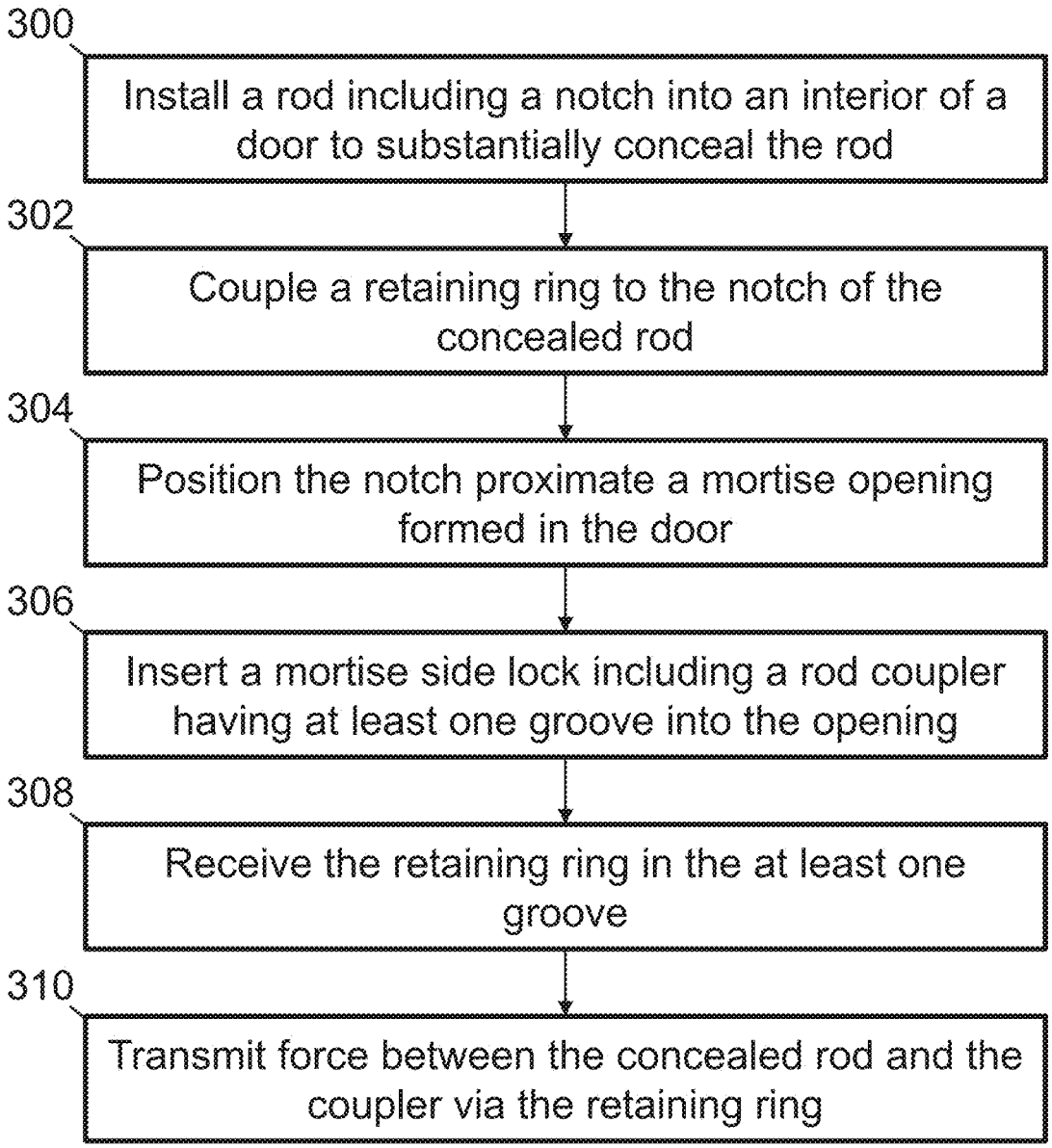
FIG. 15 is a block diagram of one embodiment for a method of installing an exit device according to exemplary embodiments described herein.

FIG. 15 is a block diagram of one embodiment for a method of installing an exit device according to exemplary embodiments described herein. In block 300, a concealed rod having a notch is installed in an interior of a door so that it is substantially concealed. In block 302, a retaining ring is coupled to the notch of the rod. In block 304, the notch is positioned proximate a mortise opening formed in the door. That is, the notch and retaining ring may be visible and/or accessible through the mortise opening. In some embodiments, the retaining ring may be provided with the rod, and the notch and retaining ring may be positioned proximate a mortise opening when the rod is installed into the door without further adjustment. In block 306, a mortise side latch including a rod coupler is inserted into the mortise opening, where the rod coupler includes at least one groove. In block 308, the retaining ring is received in the at least one groove. In some cases, the retaining ring may be received in the at least one groove as a result of one or more inclined lead-ins which guide the retaining ring towards the nearest of the at least one groove. In block 310, force is transmitted between the concealed rod and the coupler via the retaining ring disposed in the at least one groove. For example, the retaining ring may transmit linear force (e.g., compression or tension) which is applied along a longitudinal axis of the concealed rod.

Figure 16:
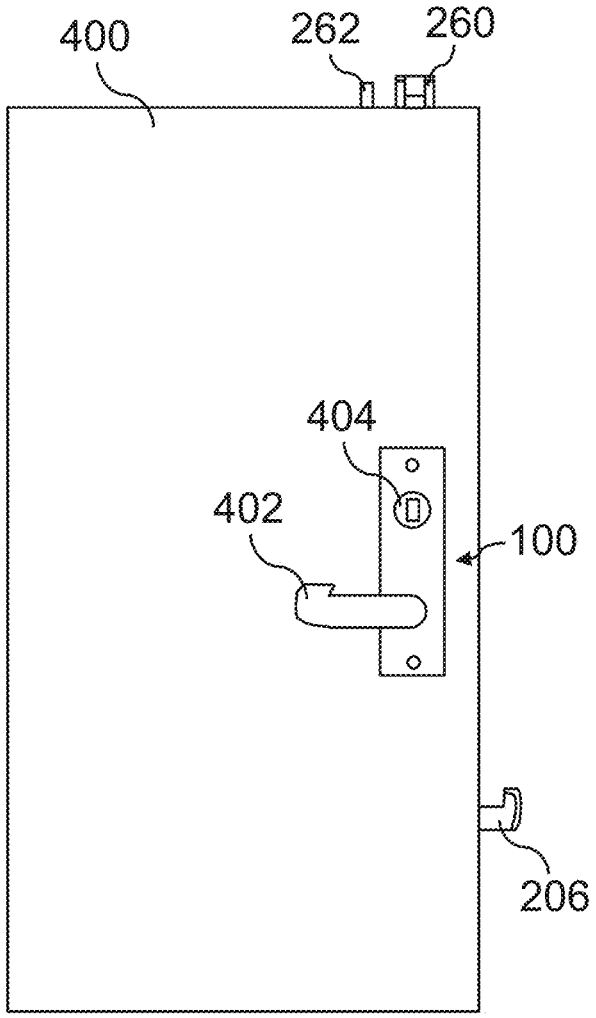
FIG. 16 is a front elevation view of one embodiment of a door including an exit device according to exemplary embodiments described herein.

FIG. 16 is a front elevation view of one embodiment of a door 400 including and exit device 100 according to exemplary embodiments described herein. As shown in FIG. 16, the door includes an exit device 100 having a transom latch head 260, a trigger 2662, and a hook latch head 206 which projects from a side of the door. According to the state shown in FIG. 4, the exit device is in the secured position with the transom latch head 260 in an engaged position and the hook latch head 206 in a hook engaged position which would secure the door to an associated door frame transom and door jamb, respectively. As discussed previously, the trigger 262 may be configured to allow the transom latch head and the hook latch head to extend automatically when the door is closes without significant interference with the door frame. As shown in FIG. 16, the door also includes a handle 402 and a keyhole 404. The handle may be coupled to a handle attachment of an actuator of the exit device, so that the handle may be turned to move the transom latch head and hook latch head toward a disengaged position and hook disengaged position, respectively. The keyhole may be operated with the use of a corresponding key which may be used to selectively allow use of the handle (i.e., lock or unlock the handle of the door). Of course, any suitable locking device and user interface for interacting with the exit device may be employed in a door, as the present disclosure is not so limited.

Figure 17:
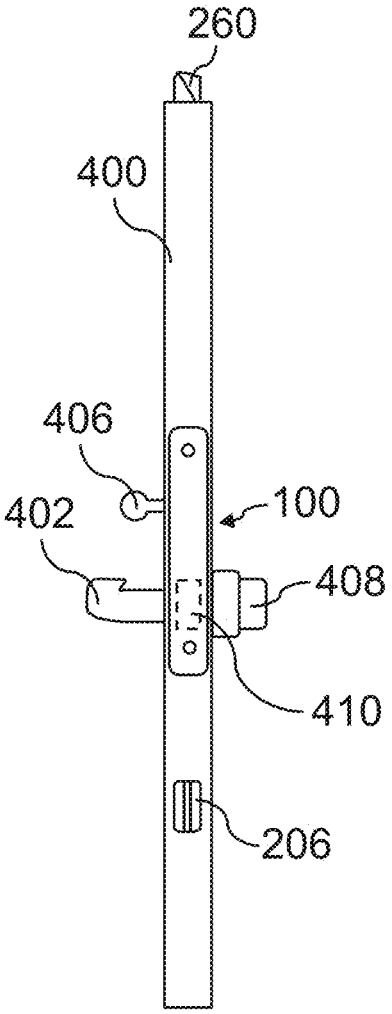
FIG. 17 is a side elevation view of the door of FIG. 16.

FIG. 17 is a side elevation view of the door 400 of FIG. 16. As shown in FIG. 16, the side of the door opposite that of the handle 402 includes a push bar 408 which may be used to actuate a lever of the exit device 100. That is, a user may push on the push bar 408 to rotate the lever to move the hook latch head 206 and transom latch head 260 toward a disengaged position and hook disengaged position, respectively, to release the door. In some embodiments, the push bar may be positioned on an interior side of the door which swings outward for efficient egress of an interior space. Of course, while a push bar is shown in FIG. 17, any suitable user interface device which allows a user to actuate the exit device may be employed, as the present disclosure is not so limited. According to the embodiment shown in FIG. 17 and discussed previously, a key 406 may be used to selectively allow actuation of the exit device with the handle 402. Such an arrangement may be beneficial to lock an exterior side of the door on which the handle may be disposed. In some embodiments, the exit device may include an optional third latch head 410 disposed near the handle 402 and push bar 408 which is moved between an engaged position and disengaged position in conjunction with the transom latch head 260 and hook latch head 206. Of course, any suitable number of latch heads or bolts may be employed in the exit device to secure the door to an associated door frame, as the present disclosure is not so limited.

Figure 18:
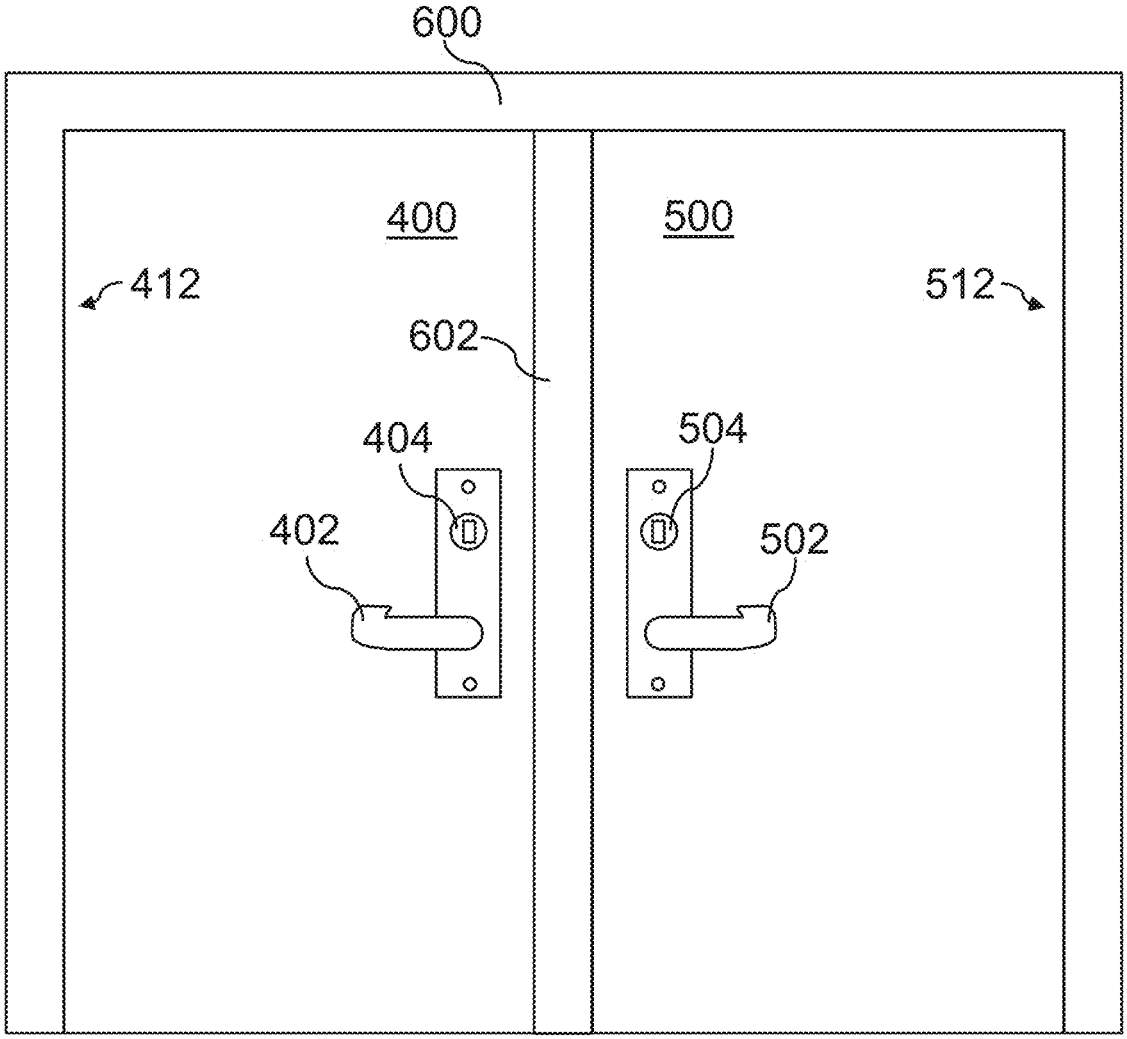
FIG. 18 is a front elevation view of another embodiment of a door and a door frame.

FIG. 18 depicts one embodiment of a door including a first door panel 400, a second door panel 500, and a door frame 600 having a mullion 602. The first door panel is mounted to the door frame at a first hinge interface 412 and the second door panel is mounted to the door frame at a second hinge interface 512. As shown in FIG. 18, a first handle 402 is mounted to the first door panel and is configured to operate an exit device attached to the door. The exit device may include a transom latch and a side latch, similar to the embodiment shown in FIGS. 16-17. Additionally a keyhole 404 may be used to selectively secure the first handle 402. According to the embodiment of FIG. 18, the exit device attached to the first door panel includes a side latch which engages the mullion 602. The mullion may be secured to the door frame transom and an underlying floor so that the secured door may withstand impacts or other forces. According to the embodiment shown in FIG. 18, the second door panel also accommodates an attached exit device which is operable with a second handle 502. Additionally, a second keyhole may be used in conjunction with a key to selectively secure the second handle. The exit device attached to the second door panel may be similar to that attached to the first door panel. In some embodiments, an exit device attached to the second door panel may not include a central actuator, and may instead include a transom bolt, mullion bolt, or bottom bolt which may be manually moved to secure the door. Of course, the second door panel may have any suitable exit device, latch head, bolt, or lock so that the door may be selectively secure to the door frame, mullion, or underlying floor, as the present disclosure is not so limited.

In some embodiments, doors secured with exit devices according to exemplary embodiments described herein may be suitable for use in high wind areas. For example, a door secured by the exit device of FIG. 1 may withstand a first impact from a 6.8 kg 2×4 piece of lumber traveling at a speed between 80 mph and 100 mph near the transom latch. The same secured door may then subsequently withstand a subsequent second impact from a 6.8 kg 2×4 piece of lumber traveling at a speed between 80 mph and 100 mph near the actuator. Finally, the same secured door may subsequently withstand a subsequent third impact from 6.8 kg 2×4 piece of lumber traveling at a speed between 80 mph and 100 mph near a hinge interface of the door. In cases where a pair of doors is employed and at least one is secured with an exit device according to exemplary embodiments disclosed herein, the secured door may withstand a subsequent fourth impact from a 6.8 kg 2×4 piece of lumber traveling at a speed between 80 mph and 100 mph near a mullion interface between the two doors. Additionally, a door secured by an exit device of exemplary embodiments described herein may withstand positive or negative pressure as a result of wind speeds between 130 and 250 mph. Withstanding the above noted impacts or pressures may be determined at least partially by measuring perforation of a witness screen placed proximate the door. That is, a door withstands impact or pressure when a #70 unbleached kraft paper witness screen with its surface secured in place on a rigid frame installed within 5 inches of the interior surface of the door remains unperforated after the impact or pressure. Furthermore, a door may withstand impact or pressure when permanent deformation of the door measured from a straight edge held between two undeformed points on the door is less than or equal to 3 inches. Of course, doors secured by the exit devices of embodiments described herein may meet any suitable standards for use in high wind areas, storm shelters, etc., including, but not limited to ICC 500, FEMA P361, FEMA P320, or any other modern or updated testing standard, as the present disclosure is not so limited.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. An exit device, comprising:

an actuator including a lever, a first cam, and a second cam, wherein the first cam is configured to convert an actuation force applied to the lever to a first force in a first direction, and wherein the second cam is configured to convert the actuation force applied to the lever to a second force in a second direction;

a first rod coupled to the first cam configured to transmit the first force in the first direction;

a second rod coupled to the second cam configured to transmits the second force in the second direction;

a transom latch including a latch head configured to move between an engaged position and a disengaged position coupled to the first rod, wherein, when the first rod transmits the first force in the first direction, the latch head is moved from the engaged position to the disengaged position; and a side latch including a hook latch head configured to move between a hook engaged position and a hook disengaged position coupled to the second rod, wherein, when the second rod transmits the second force in the second direction, the hook latch head is moved from the hook engaged position to the hook disengaged position, wherein the hook latch head rotates between the hook engaged position and the hook disengaged position, and wherein the hook latch head is coupled to the second rod by a rack and pinion interface.

2. The exit device of claim 1, wherein the second rod includes a retaining ring, and wherein the side latch includes a rod coupler having at least one groove configured to receive the retaining ring, wherein, when the retaining ring is received in the at least one groove, the second force may be transmitted between the side latch and the second rod in the second direction.

3. The exit device of claim 1, further comprising a rod guide configured to slidably receive the second rod, wherein the rod guide constrains the second rod to motion in either the first direction or the second direction.

4. The exit device of claim 3, wherein the second direction is a vertical direction relative to an associated door.

5. The exit device of claim 1, wherein the transom latch further comprises a biasing member configured to bias the latch head toward the engaged position.

6. The exit device of claim 5, wherein the biasing member is configured to apply a biasing force to the first rod in a direction opposite the first direction and apply the biasing force to the second rod in a direction opposite the second direction, and wherein the biasing member urges the hook latch head toward the hook engaged position.

7. The exit device of claim 6, wherein the transom latch further comprises a lockout and a trigger, wherein the lockout is configured to retain the latch head in the disengaged position and the hook latch head in the hook disengaged position, wherein the trigger is configured move between an extended position and a retracted position, and wherein the trigger releases the latch head and the hook latch head when the trigger is moved to the retracted position.

8. The exit device of claim 7, wherein the lockout includes a first camming surface, and wherein the trigger includes a second camming surface, wherein the second camming surface applies a force to the first camming surface when the trigger is moved to the retracted position.

9. The exit device of claim 7, wherein, when the trigger releases the latch head and the hook latch head, the latch head moves automatically to the engaged position and the hook latch head moves automatically to the hook engaged position under urging from the biasing member.

10. An actuator for an exit device, comprising:

a chassis;

a lever rotatably mounted to the chassis by a hinge portion and including a cam engagement portion;

a first cam coupled to a first rod holder, wherein the first rod holder is slidably disposed in the chassis which allows movement of the first rod holder along a first axis; and a second cam coupled to a second rod holder, wherein the second rod holder is slidably disposed in the chassis which allows movement of the second rod holder along a second axis;

wherein the cam engagement portion engages the first cam and the second cam concurrently when the lever is rotated about the hinge portion by a user to move the first rod holder in a first direction along the first axis and the second rod holder in a second direction along the second axis, wherein the first rod holder includes a deadlatching catch to directly inhibit movement of the first rod holder in the first direction without rotation of the lever by a user.

11. The actuator of claim 10, wherein the first cam is rotatably coupled to the chassis, wherein the second cam is rotatably coupled to the chassis, wherein the first cam and the second cam are configured to rotate in opposite directions when the cam engagement portion engages the first cam and the second cam.

12. The actuator of claim 10, wherein the first cam includes a first cam lobe, a first upper arm, and a first lower arm, wherein the second cam includes a second cam lobe, a second upper arm, and a second lower arm, wherein the first upper arm is engaged with the second lower arm, wherein the second upper arm is engaged with the first lower arm.

13. The actuator of claim 10, further comprising a slider disposed at least partially in a slider slot formed in the chassis which allows movement of the slider in the first direction and the second direction, wherein the slider includes an inclined camming surface configured to contact the lever and rotate the lever about the hinge portion when the slider is moved in the first direction or the second direction.

14. The actuator of claim 13, further comprising a handle attachment including a wing configured to engage and move the slider when an attached handle is turned to contact and rotate the lever about the hinge portion.

15. The actuator of claim 14, wherein the wing is configured to move the slider in the first direction.

16. The actuator of claim 10, wherein the first rod holder is configured to receive external biasing force and transmit the external biasing force to the first cam, the second cam, and the lever.

17. The actuator of claim 16, wherein the external biasing force urges the first rod holder in a direction opposite the first direction and the second rod holder in a direction opposite the second direction.

18. The actuator of claim 10, wherein the second rod holder includes a second deadlatching catch configured to inhibit movement of the second rod holder in the second direction without rotation of the lever by a user.

* * * * *